US005611722A

United States Patent [19]

Osborne

[11] Patent Number: 5,611,722

[45] Date of Patent: Mar. 18, 1997

[54] PANTY HAVING KNIT-IN BUTTOCK LIFT AND SEPARATION

[75] Inventor: Harold G. Osborne, Boomer, N.C.

[73] Assignee: Alba-Waldensian, Inc., Valdese, N.C.

[21] Appl. No.: 382,864

[22] Filed: Feb. 3, 1995

[51] Int. Cl.[6] ..... A41C 1/00; A41B 9/00

[52] U.S. Cl. ..... 450/99; 450/131; 450/132; 2/401

[58] Field of Search ..... 450/99, 97, 98, 450/131, 132; 66/177, 172 E, 191; 2/401

[56] References Cited

U.S. PATENT DOCUMENTS

| | | | |
|---|---|---|---|
| 2,000,073 | 5/1935 | Goas | 66/177 X |
| 2,193,467 | 3/1940 | Rutledge | 2/401 |
| 2,285,012 | 6/1942 | Burkey | 66/177 |
| 2,668,953 | 2/1954 | Tofanelli . | |
| 2,684,482 | 7/1954 | Rutledge | 2/401 X |
| 2,736,036 | 2/1956 | Sinigagliesi | 66/177 X |
| 2,792,698 | 5/1957 | Hampp | 2/401 X |
| 2,928,397 | 3/1960 | Pucci . | |
| 2,980,114 | 4/1961 | Montoya . | |
| 3,060,938 | 10/1962 | Katterman et al. | 450/131 X |
| 3,131,698 | 5/1964 | Morano . | |
| 3,368,563 | 2/1968 | Scheier | 66/177 X |
| 3,375,829 | 4/1968 | Brennan et al. . | |
| 3,413,824 | 12/1968 | Kuney . | |
| 4,325,379 | 4/1982 | Ozbey . | |
| 4,400,832 | 8/1983 | Kinder . | |
| 4,527,403 | 7/1985 | Fullbright et al. | 66/177 |
| 4,722,202 | 2/1988 | Imboden | 2/401 X |
| 5,131,100 | 7/1992 | Atwater et al. | 2/401 X |

FOREIGN PATENT DOCUMENTS

| | | |
|---|---|---|
| 988691 | 8/1951 | France . |
| 1266657 | 11/1961 | France . |
| 2095158 | 2/1972 | France . |
| 2168886 | 7/1986 | United Kingdom . |

*Primary Examiner*—C. D. Crowder
*Assistant Examiner*—Shirra L. Jenkins
*Attorney, Agent, or Firm*—Bell, Seltzer, Park & Gibson, P.A.

[57] ABSTRACT

The invention discloses a panty-type undergarment having a support panel which has a greater resistance to stretch than the rest of the undergarment for lifting and separating the cheeks of a wearer's buttocks. The support panel is substantially anchor-shaped and includes a vertical strip and upwardly curving portions which extend toward and along a portion of the undergarment leg openings. The undergarment is circularly knit and includes modified knit regions to form the portions forming the support panel. A method and blank for making the panty with the lift and separation support are also disclosed.

20 Claims, 3 Drawing Sheets

PANTY HAVING KNIT-IN BUTTOCK LIFT AND SEPARATION

BACKGROUND OF THE INVENTION (1) Field of the Invention

The present invention relates to a panty-type undergarment for lifting and separating the cheeks of a wearer's buttocks, a blank for making the panty and a method for making the panty. More specifically, the invention relates to a panty-type undergarment having knit-in lift and separation support, and a blank and method for making the panty.

(2) Description of the Prior Art

As an effect of the aging process, many people experience a drooping and flattening of their posterior region. The appearance of a saggy posterior is seen by many people to be unattractive; therefore attempts have been made to provide a means for enhancing the appearance of a droopy posterior.

For example, U.S. Pat. No. 2,928,397 to Pucci and U.S. Pat. No. 3,131,698 to Morano disclose girdle-type undergarments for enhancing the appearance of a wearer's posterior. The girdle of the Pucci patent utilizes a two-part, non-stretchable panel covering the inner half of each buttocks cheek, and a center seam for extending between the two cheeks. The girdle of the Morano patent utilizes a panel of vertically stretchable material to form the back girdle portion, with the remainder of the girdle being formed of two-way stretch material. Both the Pucci and Morano girdles require the forming and seaming of individual panels to form the completed girdle; therefore production of these garments tends to be labor intensive and costly.

U.S. Pat. No. 2,980,114 to Montoya discloses a skirted girdle which attempts to avoid pressing together the individual buttocks by providing separate girdle panels which are joined together by way of elastic or open work bands. Because the individual panels must be attached to the bands and specially sewn or configured to provide fullness for accommodating the buttocks, the production of this girdle tends to be labor intensive as well.

U.S. Pat. No. 3,413,824 to Kuney discloses knitted garments which include form-fitting pockets in order that they can accentuate specific portions of the body. The nether garments disclosed include spaced concave and convex areas to accentuate the shape of the wearer's buttocks.

Thus, a need exists for panty-type undergarments which provide for effective lift and separation of a wearer's buttock cheeks which can be rapidly and efficiently manufactured using a minimal number of manufacturing steps.

SUMMARY OF THE INVENTION

It is therefore an object of the present invention to provide a panty-type undergarment having a support panel for lifting and separating the individual cheeks of a wearer's buttocks.

It is also an object of the present invention to provide a method for making such a panty-type undergarment by circular knitting.

It is a further object of the invention to provide a blank which can be used to form a panty having a support panel for lifting and separating the individual cheeks of a wearer's buttocks. It is another object of the invention to provide a method for knitting such a blank on a circular knitting machine.

In accordance with the present invention, there is described a circularly-knit panty-type undergarment having a support panel for lifting and separating the individual cheeks of a wearer's buttocks. As used herein, the term "panty-type undergarment" refers to articles of wearing apparel used to clothe at least a portion of a person's body between the waist and thighs, a portion of which extends between a wearer's legs. The panty-type undergarment includes a front panel adapted to cover at least a portion of the front of a person between the waist and juncture of the thighs, and a rear panel for covering at least a portion of the buttocks of the wearer. The front and rear panels are joined together along first and second sides and along a crotch portion to define first and second leg openings.

The lift and separation support panel is knit so that it has a greater resistance to stretch than the remainder of the rear panel. The support panel is integrally knit with the rear panel and is substantially anchor-shaped so that it extends vertically through the center of the rear panel and curves around toward and along a portion of the first and second leg openings so that it conforms to the regions of a wearer's body corresponding to the areas between and beneath the wearer's buttock cheeks.

In a preferred embodiment of the invention, the front and rear panels are integrally knit on a circular knitting machine in the form of a tubular blank. The courses forming the blank are periodically modified during formation of the tubular blank to form a substantially anchor-shaped region which has a greater resistance to stretching than the remainder of the tubular structure. The anchor-shaped region includes a walewise extending strip and two upwardly curved portions extending outwardly from a lower portion of the walewise extending strip. The more stretch resistant region is formed by any conventional method, such as floating in an elastic yarn or holding a yarn used to form the series of courses in selected alternating courses. Desirably, the tubular blank also includes a turned welt about its upper portion, which forms a waistband on the completed panty.

First and second spaced portions of the tubular blank are then cut and removed to define first and second leg openings and a crotch portion therebetween. The crotch portion between the leg openings is joined to the rear panel portion of the tubular blank to form a completed panty. Preferably, elastic banding is attached around the leg openings in order that the leg openings can conform to a wearer's legs when the panty is worn. Thus, a panty having a buttocks lift and separation support panel can be readily formed with only a minimum number of steps and without requiring a large amount of labor input.

Other objects, features and advantages of the present invention will become apparent from the following detailed description when taken in conjunction with the accompanying drawings.

DESCRIPTION OF THE PREFERRED EMBODIMENTS

Figure 1:
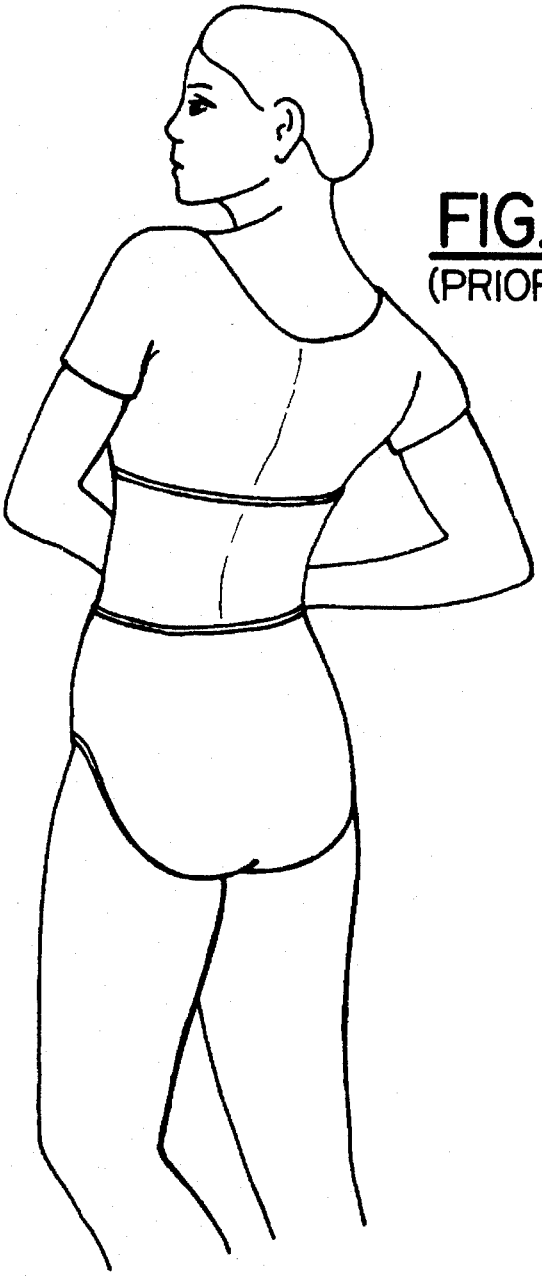
FIG. 1. (PRIOR ART)
FIG. 1 is a view of a person wearing prior art panties, showing the accompanying posterior droop.
Figure 2:
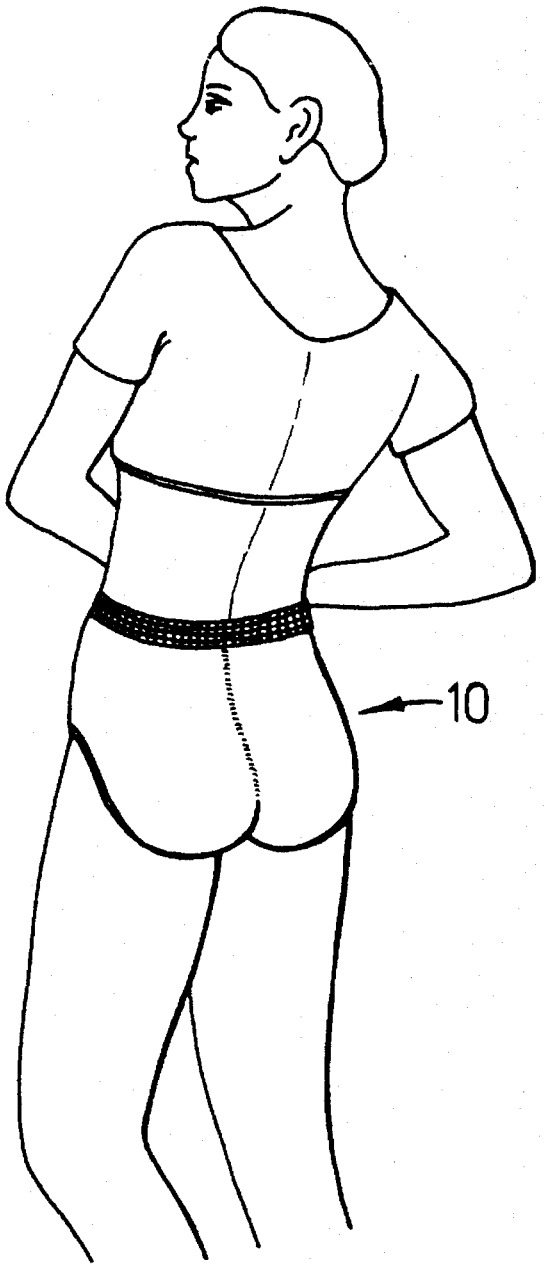
FIG. 2 is a view of a person wearing panties of the present invention, showing the performance of the lift and separation support panel.

Referring now to the drawings, FIGS. 1 and 2, respectively, show comparative views of a prior art panty and a panty according to the present invention. As shown in FIG. 1, the prior art panty allows a wearer's buttocks to droop, making an unappealing appearance. In contrast, FIG. 2 shows an environmental view of a panty 10 according to the present invention. As clearly shown in the drawing, the panty 10 lifts and separates the cheeks of a wearer's buttocks, giving a more shapely and youthful appearance to the wearer's body.

Figure 3:
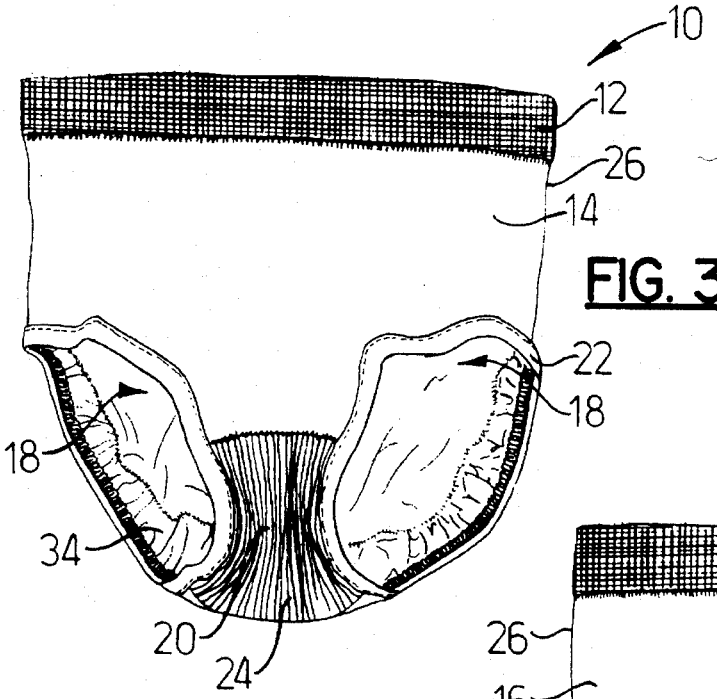
FIG. 3 is a frontal view of a panty according to the present invention.

FIG. 3 shows a front view of a panty 10 according to the invention. The panty 10 includes a front panel 14 and a rear panel 16. The front panel 14 can assume any of a variety of conventional configurations, and can be specially configured to accommodate either female or male anatomy. The panty 10 desirably includes a waistband 12 for securing the panty about a wearer's waist, which can be made in the form of an integrally knitted turned welt or as an attached piece of elastic banding, for example. The panty 10 includes first and second leg openings 18 which define a crotch portion 20 therebetween. The crotch portion 20 can be formed in any conventional manner, and desirably includes a pile surface for contacting the wearer's body. In a preferred embodiment of the invention, elastic banding 22 is provided around each of the leg openings 18 so that the banding reduces the diameter of the leg openings 18. In this way, the leg openings can readily expand to allow a wearer's legs to enter the leg openings 18 and contract to securely grip the legs and maintain the panty in its proper position on the wearer's body.

The front panel 14 is joined to the rear panel 16 at a seam 24 adjacent crotch portion 22, and along first and second sides 26. Preferably, seam 24 is a sewn seam and the front and rear panels are joined at sides 26 by knitting them integrally.

Figure 4:
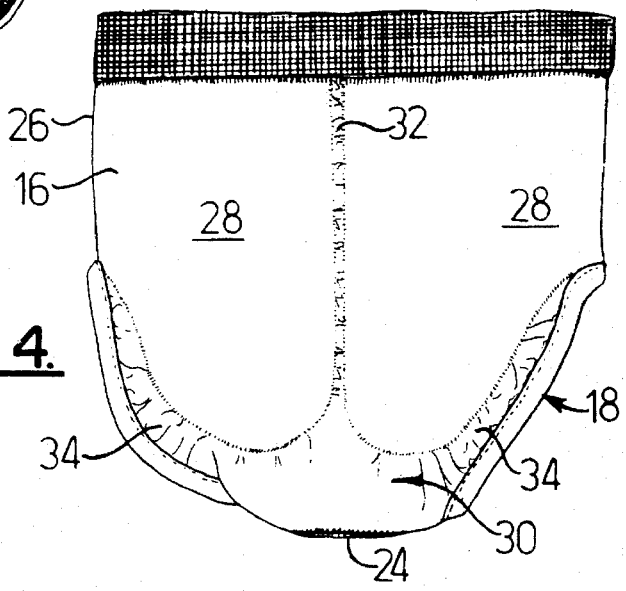
FIG. 4 is a rear view of a panty according to the present invention.

As shown in FIG. 4, the panty 10 includes an integrally knit support panel 30 on its rear panel 16. The support panel 30 is substantially anchor-shaped, and includes a vertically extending strip 32 and portions 34 which curve outwardly from the strip 32 toward and along a portion of said first and second leg openings 18, to thereby conform to those regions of a wearer's body corresponding to the areas between and beneath a wearer's buttock cheeks.

The support panel 30 is formed so as to have greater resistance to stretch, particularly in the walewise direction, than the remainder 28 of the rear panel 16. In this way, the curved portions 34 tuck underneath a wearer's buttocks while vertically extending strip 32 cooperates with the curved portions 34 to lift and separate the individual buttock cheeks.

Figure 5:
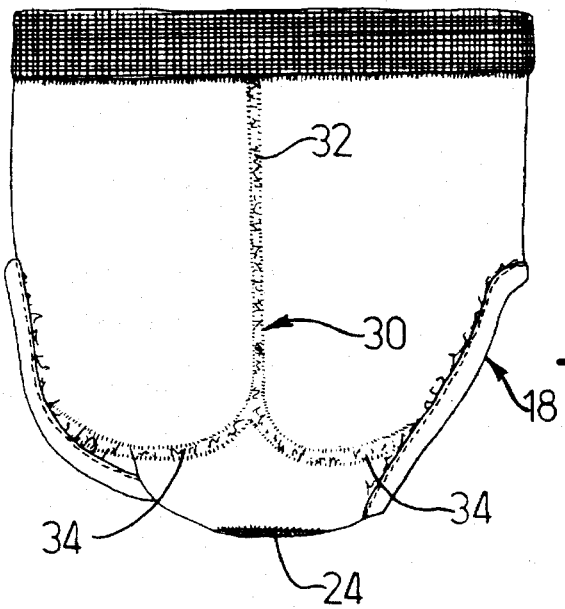
FIG. 5 is a rear view of a panty according to the present invention, showing a modified form of the support panel.

The support panel 30 can be made to extend from underneath the cheeks to the seam 24 joining the front and rear panels 14 and 16, as shown in the embodiment in FIG. 4. Alternatively, the curved portions 34 of the support panel 30 can assume a strip-like configuration, as shown in the embodiment of FIG. 5. The embodiment of FIG. 5 depicts the curved portions 34 having a thickness similar to that of the vertically extending strip 32. However, it is noted that the curved portions 34 could be thicker than the vertically extending strip 32, while still not extending all the way to the seam 24 joining the front and rear panels 14 and 16.

Figure 6:
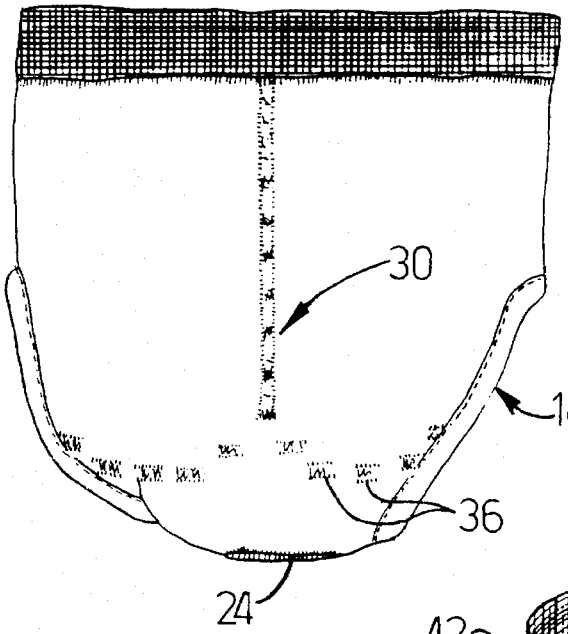
FIG. 6 is a rear view of a panty according to the present invention, showing a second modified form of the support panel.

As shown in the embodiment in FIG. 6, the support panel 30 can be made of individual spaced regions 36, provided the overall effect is to form a substantially anchor-shaped support panel which conforms to the regions corresponding to those regions of a wearer's body corresponding to the areas between and beneath a wearer's buttock cheeks.

Figure 7:
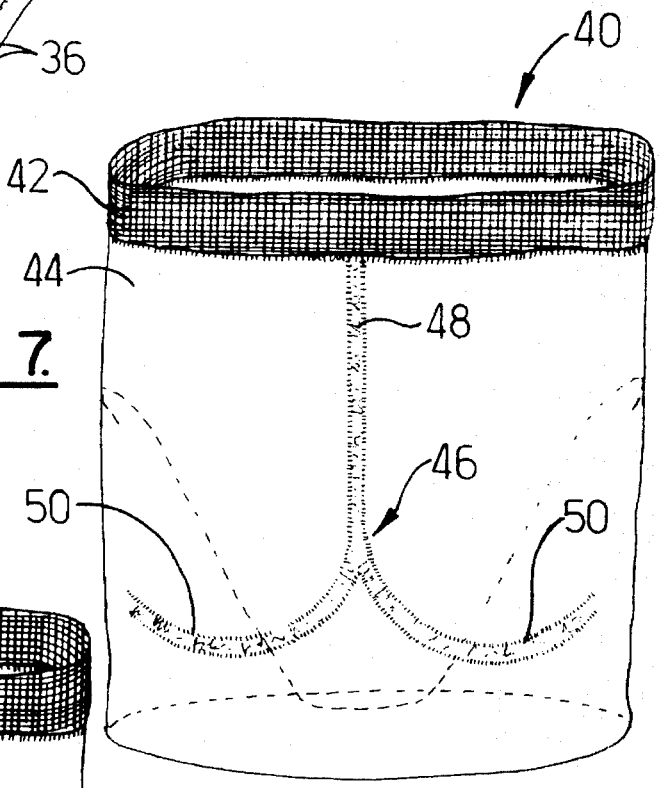
FIG. 7 depicts a rear panel portion of a tubular blank according to the present invention.
Figure 8:
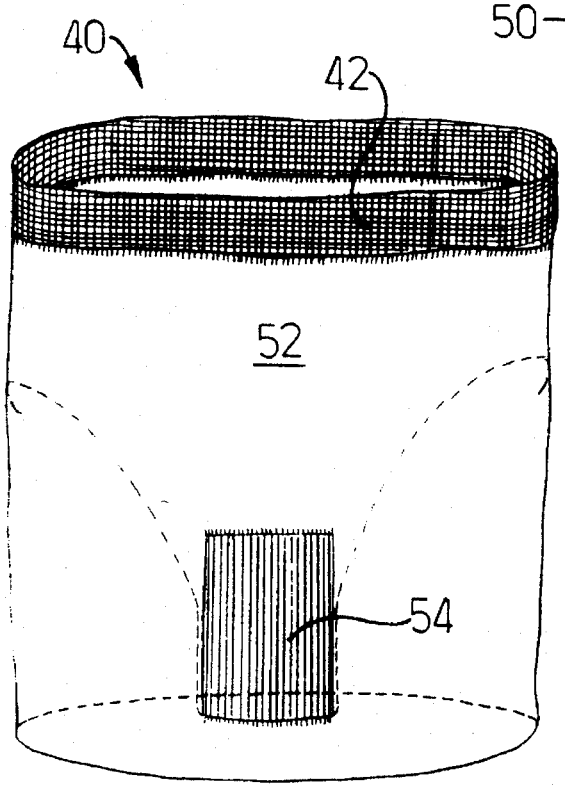
FIG. 8 depicts a front panel portion of a tubular blank according to the present invention.

FIGS. 7 and 8 depict rear and front views, respectively, of a blank for forming a panty according to the invention. The tubular blank, shown generally at 40, preferably includes a turned welt portion about its upper end. The tubular blank includes a first side 44 for forming the rear panel 16 of a panty. The first side 44 is integrally knit with second side 52, which forms the front panel 14 of a panty. The first side 44 includes a substantially anchor-shaped region 46 which is knitted so as to be more resistant to stretch than the remainder of the first side 44 of the blank 40. This substantially anchor-shaped region 46 of the blank 40 forms the support panel 30 of the completed panty 10, and includes a walewise extending strip 48 and two upwardly curved portions 50 which extend outwardly from a lower portion of the walewise extending strip 48.

As shown in FIG. 8, the second side 52 of the blank 40 preferably includes a region 54 having a modified knit configuration for forming the crotch portion 20 of the panty 10. A particularly preferred knit configuration is a pile-forming configuration, for forming a pile surface on the wearer-contacting surface of the crotch portion 20.

The manufacture of a panty according to the present invention is performed as follows: a series of courses is knitted on a circular knitting machine to form a tubular blank 40 having a substantially anchor-shaped region 46 which is more resistant to stretch than the remainder of the tubular blank and integrally formed with the tubular blank. This is preferably done by floating in an extra elastic yarn in the more stretch resistant region or by forming this region using a pucker stitch, wherein yarns are held during the formation of selected portions of selected alternating courses. However, other conventional methods for forming this region so that it is more stretch resistant than the rest of the blank can be employed.

The substantially anchor-shaped region 46 includes a walewise extending strip 48 and two upwardly curved portions 50 extending outwardly from a lower portion of the walewise extending strip 48. In addition, the tubular blank 40 is also desirably knit to have a turned welt 42 about its upper end, at a position remote from the upwardly curved portions 50 of the substantially anchor-shaped region 46. In a preferred embodiment of the invention, the tubular blank 40 also includes a region 54 on the side of the blank 40 opposite that having the substantially anchor-shaped region 46. The region 54 has a pile forming knit configuration which forms the crotch portion of the panty.

The tubular blank 40 is then cut and first and second spaced areas of the blank are removed to form first and second leg openings and define a crotch portion therebetween and front and rear panty panels 14 and 16. The front and rear panty panels 14 and 16 are then joined together between the leg openings 18 at the seam 24, which preferably is a sewn seam. In addition, elastic banding 22 is desirably attached around the leg openings 18, to reduce the diameter of the openings. However, it is noted that the front and rear panels 14 and 16 can be attached together at seam 24 prior to cutting and removing the first and spaced areas to form the leg openings.

In the drawings and the specification, there has been set forth a preferred embodiment of the invention, and although specific terms are employed, they are used in a generic and descriptive sense only and not for purposes of limitation, the scope of the invention being defined in the claims.

That which is claimed is:

1. A panty for lifting and separating the cheeks of a wearer's buttocks comprising:

a front panel adapted to cover a front portion of a wearer's body between the waist and juncture of the thighs;

a knitted rear panel connected to said front panel along first and second rear panel sides and a crotch region, said rear panel adapted to cover a portion of a wearer's buttocks and said front and rear panels defining first and second leg openings;

said rear panel including an integrally knit support panel having a greater resistance to stretch than the remainder of the rear panel, said support panel comprising a substantially anchor-shaped region of the rear panel extending vertically through the center of the rear panel and curving around toward and along a portion of said first and second leg openings, thereby conforming to those regions of a wearer's body corresponding to the areas between and beneath a wearer's buttock cheeks.

2. The panty according to claim 1, wherein said front and rear panels are integrally knit.

3. The panty according to claim 1, wherein said front and rear panels are integrally knit in tubular form and said front panel is connected to said rear panel at said crotch region by a sewn seam.

4. The panty according to claim 1, wherein said support panel includes an extra elastic yarn floated in its knitted structure.

5. The panty according to claim 1, wherein said support panel comprises a pucker stitched fabric having alternating groups of courses with held yarns.

6. The panty according to claim 1, wherein said support panel extends substantially to said crotch region.

7. The panty according to claim 1, wherein said support panel extends to uppermost portions of said first and second leg openings.

8. The panty according to claim 1, further comprising elastic bands extending circumferentially about said first and second leg openings.

9. The panty according to claim 1, further comprising an elastic waistband portion located about upper portions of said front and rear panels.

10. The panty according to claim 9, wherein said elastic waistband portion is integrally knit with the front and rear panels in the form of a turned welt.

11. The panty according to claim 1, wherein said support panel comprises only a substantially anchor-shaped region of the rear panel extending vertically through the center of the rear panel and curving around toward said first and second leg openings.

12. A method of making a blank for a panty having a support panel for lifting and separating the cheeks of a wearer's buttocks comprising the steps of:

knitting a series of courses to form a tubular structure, and periodically modifying said series of courses to form a substantially anchor-shaped region having greater resistance to stretch than the remainder of the tubular structure, said substantially anchor-shaped region including a walewise extending strip and two upwardly curved portions extending outwardly from a lower portion of said walewise extending strip.

13. The method according to claim 12, wherein said step of periodically modifying said series of courses comprises floating in an elastic yarn in said substantially anchor-shaped region.

14. The method according to claim 12, wherein said step of periodically modifying said series of courses comprises holding a yarn used to form said series of courses in selected alternating courses forming said substantially anchor-shaped region.

15. The method according to claim 12, further comprising knitting a portion of the tubular structure opposite said substantially anchor-shaped region to form a pile.

16. The method according to claim 12, further comprising knitting a series of courses in the form of a turned welt to said tubular structure in a region corresponding to an upper portion of said walewise extending strip.

17. A circularly knit blank for the manufacture of a panty having a support panel for lifting and separating the cheeks of a wearer's buttocks comprising:

a tubular knitted fabric portion having an integrally formed substantially anchor-shaped region having a greater resistance to stretching than the remainder of the tubular structure, said substantially anchor-shaped region including a walewise extending strip and two upwardly curved portions extending outwardly from a lower portion of said walewise extending strip.

18. The blank of claim 17, further comprising a cylindrical tubular portion in the form of a turned welt integrally knitted to a portion of said tubular knitted fabric portion at a position remote from said upwardly curved portions of said substantially anchor-shaped region.

19. A method of making a panty having a support panel for lifting and separating the cheeks of a wearer's buttocks comprising the steps of:

knitting a series of courses to form a tubular structure, and periodically modifying said series of courses to form a substantially anchor-shaped support panel having greater resistance to stretching than the remainder of the tubular structure, said substantially anchor-shaped support panel including a walewise extending strip and two upwardly curved portions extending outwardly from a lower portion of said walewise extending strip, cutting and removing from said tubular structure first and second spaced areas to form first and second leg openings and define front and rear panty panels so that said substantially anchor-shaped support panel is located on said rear panel, and attaching the front panty panel to said rear panty panel between said leg openings to form a completed panty.

20. The method according to claim 19, wherein said step of attaching comprises sewing the front panty panel to said rear panty panel.

* * * * *